US008847569B2

(12) United States Patent
Terada et al.

(10) Patent No.: US 8,847,569 B2
(45) Date of Patent: Sep. 30, 2014

(54) SEMICONDUCTOR INTEGRATED CIRCUIT FOR REGULATOR

(75) Inventors: Akihiro Terada, Tama (JP); Kohei Sakurai, Tama (JP); Yoichi Takano, Tama (JP)

(73) Assignee: Mitsumi Electric, Ltd., Tokyo (JP)

( * ) Notice: Subject to any disclaimer, the term of this patent is extended or adjusted under 35 U.S.C. 154(b) by 462 days.

(21) Appl. No.: 13/277,435

(22) Filed: Oct. 20, 2011

(65) Prior Publication Data

US 2012/0098513 A1 Apr. 26, 2012

(30) Foreign Application Priority Data

Oct. 21, 2010 (JP) ..... 2010-236106

(51) Int. Cl.
*G05F 1/00* (2006.01)
*G05F 1/573* (2006.01)
*G05F 1/575* (2006.01)

(52) U.S. Cl.
CPC ..... *G05F 1/5735* (2013.01); *G05F 1/575* (2013.01)
USPC ..... 323/285; 323/284

(58) Field of Classification Search
CPC ..... G05F 1/5735; G05F 1/575
USPC ..... 323/268, 271, 282, 284, 285
See application file for complete search history.

(56) References Cited

U.S. PATENT DOCUMENTS 6,229,293 B1 * 5/2001 Farrenkopf ..... 323/288
6,914,421 B2 * 7/2005 Yamamoto ..... 323/289
7,135,842 B2 * 11/2006 Banerjee et al. ..... 323/275
7,439,798 B2 * 10/2008 Kouno et al. ..... 327/541
8,004,257 B2 8/2011 Imura et al.
2004/0012905 A1 1/2004 Yamamoto
2011/0227547 A1 * 9/2011 Wong et al. ..... 323/282
2012/0025799 A1 * 2/2012 Tournatory et al. ..... 323/285

FOREIGN PATENT DOCUMENTS

CN 1776559 A 5/2006
CN 101567628 A 10/2009
JP 11103524 A 4/1999
JP 2002-049430 A 2/2002
JP 2008-052516 A 3/2008
JP 2010-170363 A 8/2010

OTHER PUBLICATIONS

Chinese Office Action dated May 20, 2014 in counterpart Chinese Application No. 2011103301115.

* cited by examiner

*Primary Examiner* — Matthew Nguyen
(74) *Attorney, Agent, or Firm* — Holtz Holtz Goodman & Chick PC

(57) ABSTRACT

A regulator includes a transistor connected between an input and an output. A feedback voltage controls the transistor to keep the output voltage constant. A first circuit functions as a comparator to compare a detection voltage from the output of the transistor and the feedback voltage when the output current is higher than a predetermined value, and functions as a buffer when the output current is lower than the predetermined value. A second circuit receives a reference voltage, the feedback voltage, and an output from the first circuit, and generates (i) a difference between the feedback voltage and the first circuit output when the reference voltage is lower than the first circuit output, and (ii) a difference voltage between the feedback voltage and the reference voltage when the reference voltage is higher than the first circuit output, and supplies a control voltage to control the output of the transistor.

7 Claims, 6 Drawing Sheets

SEMICONDUCTOR INTEGRATED CIRCUIT FOR REGULATOR

BACKGROUND OF THE INVENTION

1. Field of the Invention

The present invention relates to a direct current power supply device, and further, to a voltage regulator that converts a direct current voltage. For example, the present invention relates to a technology effective for use in a semiconductor integrated circuit (regulator-ready IC) that composes a series regulator provided with a soft start function and an overcurrent protection function.

2. Background Art

In a series regulator, for example, when an overcurrent flows out of an output terminal by the matter that a load is short-circuited, and so on, there is an apprehension that a current controlling transistor may generate heat to raise a chip temperature of an IC, causing such defects that an internal circuit malfunctions, that an element is broken, and so on.

Heretofore, in the series regulator, in order to protect such a chip from the overcurrent as described above, a current limit circuit has been provided, which has an overcurrent protection function to make control so that, when an output current Iout exceeds a predetermined value, output voltage-output current characteristics represented by a shape of a so-called "reverse C" can be established by reducing the output current Iout while lowering the output voltage Vout, for example, as shown in FIG. 9A (Japanese Patent Laid-Open Publication No. 2008-052516).

Moreover, there have also been proposed inventions regarding a voltage regulator, which is composed so as to provide a soft start circuit separately from the current limit circuit and in combination therewith in order to restrict a so-called rush current as an output current flown into a capacitor at once when a power supply is turned on (Japanese Patent Laid-Open Publication No. 2002-049430, Japanese Patent Laid-Open Publication No. 2010-170363).

FIG. 7 shows a schematic configuration of a conventional voltage regulator in which the soft start circuit and the current limit circuit are provided. In FIG. 7, reference numeral 21 denotes the soft start circuit, and reference numeral 22 denotes the current limit circuit. The current limit circuit 22 has the same circuit configuration as an overcurrent protection circuit disclosed in Japanese Patent Laid-Open Publication No. 2008-052516. A size of transistors which compose the circuit is adjusted, whereby a current restriction function, which is in accordance with a drooping type voltage-current characteristics as shown in FIG. 8A or the reverse-C type voltage-current characteristics as shown in FIG. 9A, can be imparted to the current limit circuit 22.

The soft start circuit 21 shown in FIG. 7 includes: a time constant circuit composed of a constant current source CI and a capacitor C0; a comparator CMP that compares a voltage Vst of the time constant circuit with a voltage $V_{FB}$ obtained by dividing an output voltage Vout by bleeder resistors R1 and R2; and a switching switch SW capable of switching a voltage of the time constant circuit and a reference voltage Vref and supplying the voltage and the reference voltage Vref to an error amplifier AMP.

Then, at the time when the power supply rises, the voltage Vst of the time constant circuit is supplied to the error amplifier AMP, and the output voltage Vout is raised slowly. When the output voltage Vout reaches a certain potential, then the switch SW is switched to supply the reference voltage Vref to the error amplifier AMP, and control to hold the output voltage Vout at a constant voltage is performed.

As shown in FIG. 7, in the conventional voltage regulator, the soft start circuit and the current limit circuit are composed as separate circuits. Accordingly, a circuit scale of the voltage regulator is large, and in the case of forming the voltage regulator into a semiconductor integrated circuit, there has been a problem that an increase of a chip size, and eventually, an increase of cost are brought about. Moreover, in the conventional current limit circuit, in general, the characteristics thereof are of the drooping type shown in FIG. 8A or of the reverse-C type shown in FIG. 9A, and in power consumption-output current characteristics thereof, as shown in FIG. 8B or FIG. 9B, such power consumption takes a relatively high value in a course after the overcurrent is detected. Accordingly, there are problems that a power loss is large, that the chip temperature temporarily rises to an allowable level or more, and the like.

SUMMARY OF THE INVENTION

The present invention has been made under such a background as described above. It is an object of the present invention to provide a semiconductor integrated circuit for a regulator, which is capable of realizing the soft start function and the overcurrent protection function by one circuit, and capable of reducing the circuit scale and the chip size.

Moreover, it is another object of the present invention to provide a semiconductor integrated circuit for a regulator, which is capable of preventing the power consumption from rising very much in the course of such current narrowing by the overcurrent protection function.

According to an aspect of the present invention, there is provided a semiconductor integrated circuit for a regulator, comprising:

a controlling transistor connected between an input terminal and an output terminal;

a current detection circuit that detects an output current flown from the controlling transistor and outputs a detection voltage proportional to the output current;

a feedback voltage generation circuit that generates a feedback voltage proportional to an output voltage in a reduction manner; and a control circuit that controls the controlling transistor so that the output voltage is constant in response to the feedback voltage, wherein the control circuit includes:

a first circuit that receives the detection voltage and the feedback voltage, functions as a comparator during a period in which the output current is higher than a predetermined value, and functions as a buffer that outputs a voltage proportional to the feedback voltage during a period in which the output current is lower than the predetermined value;

a second circuit that receives a voltage serving as a reference, the feedback voltage, and the voltage outputted from the first circuit, generates a voltage corresponding to a potential difference between the feedback voltage and the output voltage of the first circuit during a period in which the voltage serving as the reference is lower than the voltage outputted from first circuit, and when the voltage serving as the reference becomes higher than the voltage outputted from the first circuit, generates a voltage corresponding to a potential difference between the feedback voltage and the voltage serving as the reference, and supplies the generated voltage to a control terminal of the controlling transistor; and a current restricting transistor provided between the input terminal and the control terminal of the controlling transistor and controlled by the voltage outputted from the first circuit.

BRIEF DESCRIPTION OF THE DRAWINGS

The above and other objects, advantages and features of the present invention will become more fully understood from the detailed description given hereinbelow and the appended drawings and tables which are given by way of illustration only, and thus are not intended as a definition of the limits of the present invention, and wherein.

PREFERRED EMBODIMENTS OF THE INVENTION

A description is made below of preferred embodiments of the present invention based on the drawings.

Figure 1:
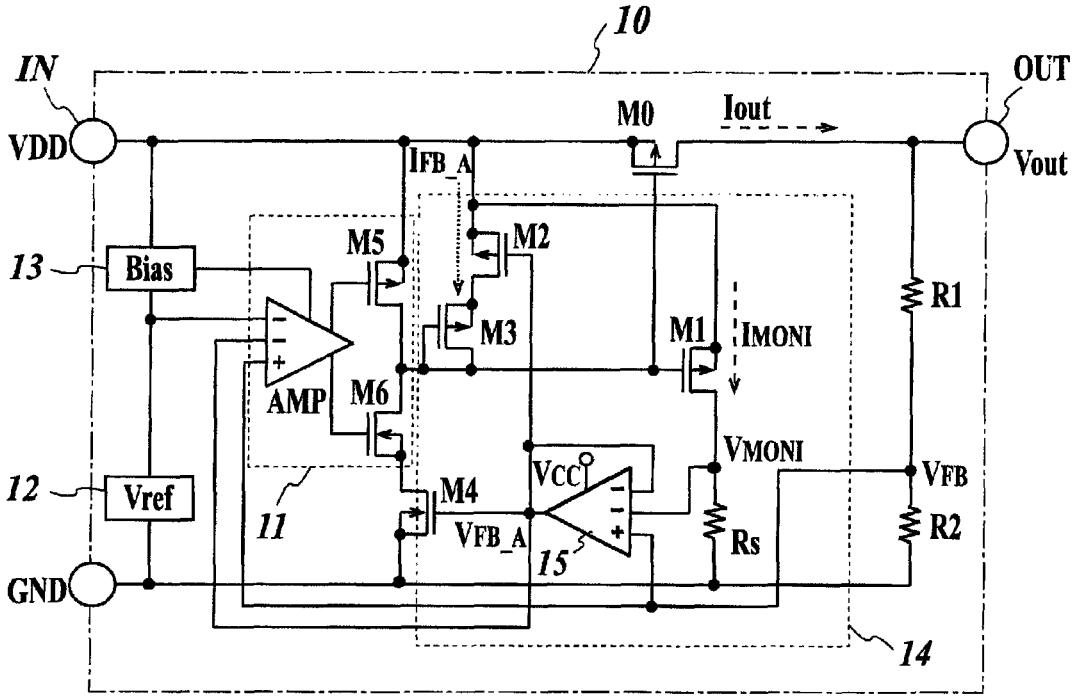
FIG. 1 is a circuit configuration diagram showing an embodiment of a controlling IC of a series regulator to which the present invention is applied.

FIG. 1 shows an embodiment of a series regulator to which the present invention is applied. Note that, though not particularly limited, an element which composes a circuit surrounded by an alternate long and short dashed line in FIG. 1 is formed on one semiconductor chip, and is composed as semiconductor integrated circuit (series regulator IC) 10.

In the series regulator IC 10 in this embodiment, a voltage controlling transistor M0 composed of a P-channel MOSFET (field effect transistor) is connected between a voltage input terminal IN and an output terminal OUT, to which a direct current voltage $V_{DD}$ from a direct current voltage supply (not shown) is applied, and between the output terminal OUT and a ground terminal GND to which a ground potential is applied, bleeder resistors R1 and R2 which divide an output voltage Vout are connected in series to each other. A voltage $V_{FB}$ obtained by dividing the output voltage Vout by the bleeder resistors R1 and R2 is subjected to feedback to a non-inverting input terminal of an error amplifier 11 that controls a gate terminal of the voltage controlling transistor M0.

Then, the error amplifier 11 controls the voltage controlling transistor M0 in response to a potential difference between such a feedback voltage $V_{FB}$ and a reference voltage Vref, and controls the output voltage Vout to become a desired potential. By such feedback control for the transistor M0, which is as described above, the series regulator of this embodiment operates so as to constantly hold the output voltage Vout when an output current Iout is a certain value or less. To the output terminal OUT, there is connected an external capacitor that stabilizes the output voltage Vout. A P-channel MOS transistor M5 and an N-channel MOS transistor M6, which are connected in series to each other between the voltage input terminal IN and the output terminal OUT, are transistors which compose an output stage of the error amplifier 11. In this embodiment, an N-channel MOS transistor M4 is further connected in series to these transistors M5 and M6.

Moreover, in the regulator IC 10 of this embodiment, there are provided: a reference voltage circuit 12, which is composed of a Zener diode and the like and serves for generating the reference voltage Vref; a bias circuit 13 that flows a bias current through the reference voltage circuit and the error amplifier 11; and a current limiter & soft start circuit 14, which is connected to the gate terminal of the voltage controlling transistor M0, and is provided with an overcurrent protection function to restrict the output current and a soft start function to prevent a flow of a rush current by slowly raising the output voltage Vout when a power supply rises.

When the output current Iout is increased and the output voltage Vout is lowered owing to a short circuit and the like of a load, and the error amplifier 11 attempts to lower a gate voltage so as to flow a more current through the transistor M0, then the overcurrent protection function of this current limiter & soft start circuit 14 restricts the output current by clamping the gate voltage so that the gate voltage cannot be lowered to a certain level or more. The MOS transistor M4 connected in series to the transistors M5 and M6 at the output stage of the error amplifier 11 is also an element that composes the current limiter & soft start circuit 14.

The current limiter and soft start circuit 14 includes a current detecting MOS transistor M1, which has a source terminal thereof connected to a source terminal of the voltage controlling transistor M0, and has a gate terminal thereof applied with the same voltage as a gate voltage of the voltage controlling transistor M0, thereby composing a current mirror with the voltage controlling transistor M0, and flowing a current $I_{MONI}$ proportional to the output current Iout flown by the voltage controlling transistor M0; and a sense resistor Rs as a current-voltage converter, which is connected in series to the MOS transistor M1, and converts a drain current of the MOS transistor M1 into a voltage. The MOS transistor M1 has a size of 1/N of the voltage controlling transistor M0, and flows a current with a magnitude of 1/N of the drain current of the voltage controlling transistor M0. Such a size ratio N can be set, for example, at a value approximately ranging from several hundred to several thousands, whereby the current $I_{MONI}$ flowing through the current detecting MOS transistor M1 can be set at an extremely small value, and a loss in such a current detecting resistor Rs can be reduced.

Moreover, the current limiter & soft start circuit 14 of this embodiment includes: a differential amplifier 15, which receives a voltage $V_{MONI}$ subjected to conversion by the resistor Rs, and the voltage $V_{FB}$ obtained by the division by the bleeder resistors R1 and R2; and two P-channel MOS transistors M2 and M3, which are connected in series to each other between the source terminal of the voltage controlling transistor M0 and the gate terminal of the current detecting MOS transistor M1, in which an output voltage of the differential amplifier 15 is applied to gate terminals of the MOS transistors M2 and M4. The MOS transistor M3 is made to function as a diode in such a manner that a gate terminal thereof and a drain terminal thereof are bonded to each other. A resistance value of the resistor Rs and a resistance ratio of the resistors R1 and R2 are Set so as to become $V_{MONI}<V_{FB}$ when the current $I_{MONI}$ flowing through the current detecting MOS transistor M1 is predetermined value or less, and to become $V_{MONI}>V_{FB}$ when the current $I_{MONI}$ exceeds the predetermined value.

Figure 2:
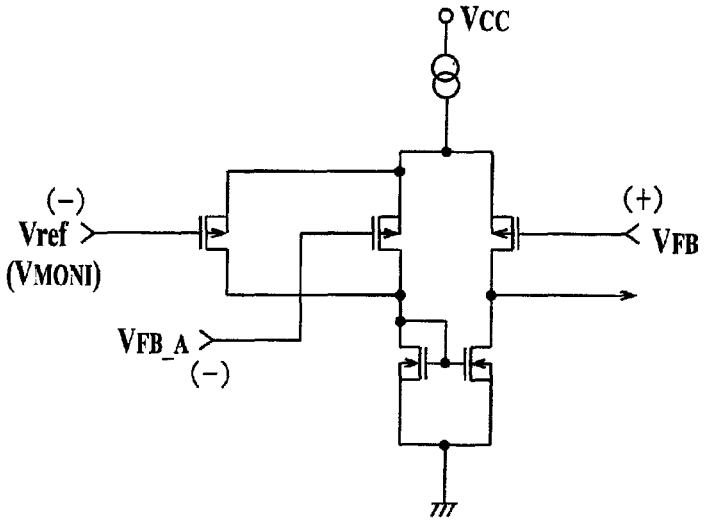
FIG. 2 is a circuit diagram showing a specific circuit example of a three-input error amplifier and a three-input differential amplifier, which compose the controlling IC of the series regulator in FIG. 1.

Moreover, in this embodiment, each of the error amplifier 11 and the differential amplifier 15 is composed of a three-input differential amplifier circuit as shown in FIG. 2, which has two inverting input terminals and one non-inverting input terminal. Then, to the two inverting input terminals of the error amplifier 11, there are inputted: the reference voltage Vref generated by the reference voltage circuit 12; and an output voltage $V_{FB_A}$ of the operational amplifier 15, and to the two inverting input terminals of the differential amplifier 15, there are inputted: the detection voltage $V_{MONI}$ subjected to the conversion by the resistor Rs; and output voltages of their own. In these three-input differential amplifier circuits, priority is given to a lower voltage among the voltages inputted to the two inverting input terminals. Moreover, to the non-inverting input terminal of each of the error amplifier 11 and the differential amplifier 15, the feedback voltage $V_{FB}$ is inputted, and each of the error amplifier 11 and the differential amplifier 15 operates in response to a potential difference thereof from the inputs to the inverting input terminals.

Next, a description is made of an entire operation of the current limiter & soft start circuit 14.

(When $V_{MONI}<V_{FB}$)

The differential amplifier 15 functions as a comparator, the output voltage $V_{FB_A}$ thereof becomes a high level (Vcc), then the MOS transistor M2 is turned to an OFF state, and the MOS transistor M4 is turned to an ON state. Therefore, the function of the current limiter is not exerted, and in addition, an ON resistance of the MOS transistor M4 is made sufficiently small, which hardly affects the output of the error amplifier 14. Accordingly, the gate of the voltage controlling transistor M0 is controlled by the output of the error amplifier 11, and control to constantly hold the output voltage Vout is performed.

(When $V_{MONI}>V_{FB}$)

The differential amplifier 15 functions as a buffer, and the output voltage $V_{FB_A}$ becomes a voltage proportional to the input voltage $V_{FB}$ to the non-inverting input terminal, that is, becomes a voltage proportional to the output voltage Vout. Moreover, the voltage $V_{FB_A}$ is set at a voltage ($V_{DD}$-Vth) lower than an input voltage $V_{DD}$ as a source voltage of the MOS transistor M2 by a threshold voltage Vth of the MOS transistor M2. Note that, though the voltage $V_{FB_A}$ lowered, the MOS transistor M4 maintains the ON state thereof. In such a way, the MOS transistor M2 is turned to an ON state, and the current $I_{FB_A}$ starts to flow through the MOS transistors M2 and M3. Then, the function of the current limiter is exerted, the gate voltage of the voltage controlling transistor M0 is raised, the output current Iout flown by the voltage controlling transistor M0 is decreased, and further, the current $I_{MONI}$ flowing through the MOS transistor M1 is also decreased.

The sizes of the respective transistors are set so that, at this time, the current $I_{FB_A}$ flowing through the MOS transistors M2 and M3 can be proportional to the current $I_{MONI}$ flowing through the MOS transistor M1. Therefore, Iout-Vout characteristics become substantially linear. The output current can be restricted only by the MOS transistor M2; however, in this embodiment, the MOS transistor M4 controlled by the output of the differential amplifier 15 in a similar way to the MOS transistor M2 is provided in series to the MOS transistor M6 located at the output stage of the error amplifier 11, whereby an influence of the output of the error amplifier 11 to the gate control voltage of the voltage controlling transistor M0 at the time when the current limit function works is made small, thus making it possible to facilitate such adjustment of the control voltage of the voltage controlling transistor M0 by the current restricting transistor M2

(At Time of Activation)

Next, a description is made of the soft start function. At the time when the soft start function is activated, if the input voltage $V_{DD}$ starts to rise, then an operation voltage is supplied to the error amplifier 11 by the bias circuit 13, and the amplifier concerned becomes operable. However, before the input voltage $V_{DD}$ rises to a certain potential, $V_{MONI}$ becomes larger than $V_{FB}$ ($V_{MONI}>V_{FB}$). Then, in a similar way to the case where the current limiter functions, the differential amplifier 15 functions as a buffer, and outputs a voltage proportional to the feedback voltage $V_{FB}$. Moreover, among the reference voltage Vref as the inputs of the two inverting input terminals of the error amplifier 11 and the output voltage $V_{FB_A}$ of the differential amplifier 15, the output voltage $V_{FB_A}$ is lower, and accordingly, the error amplifier 11 outputs a voltage corresponding to a potential difference between the output voltage $V_{FB_A}$ and the feedback voltage $V_{FB}$, and by the output concerned, controls the gate terminals of the voltage controlling transistor M0 and the current detecting transistors M1. That is to say, the current is controlled while monitoring the output voltage Vout, and the output voltage Vout is then raised gradually.

When the output voltage Vout reaches a predetermined voltage, then the output voltage $V_{FB_A}$ of the differential amplifier 15 becomes higher than the reference voltage Vref, the error amplifier 11 outputs the voltage corresponding to the potential difference between the reference voltage Vref and the feedback voltage $V_{FB}$, and constant voltage control is performed so that the output voltage Vout can be constant. In this embodiment, the sizes of the transistors, the values of the resistors, the value of the reference voltage Vref, amplification factors of the amplifiers, and the like are set so that timing when the differential amplifier 15 switches from the operation of the comparator to the operation of the buffer and timing when the input of the inverting input terminal of the error amplifier 11 is switched from the output voltage $V_{FB_A}$ of the differential amplifier 15 to the reference voltage Vref can substantially coincide with each other.

Figure 3:
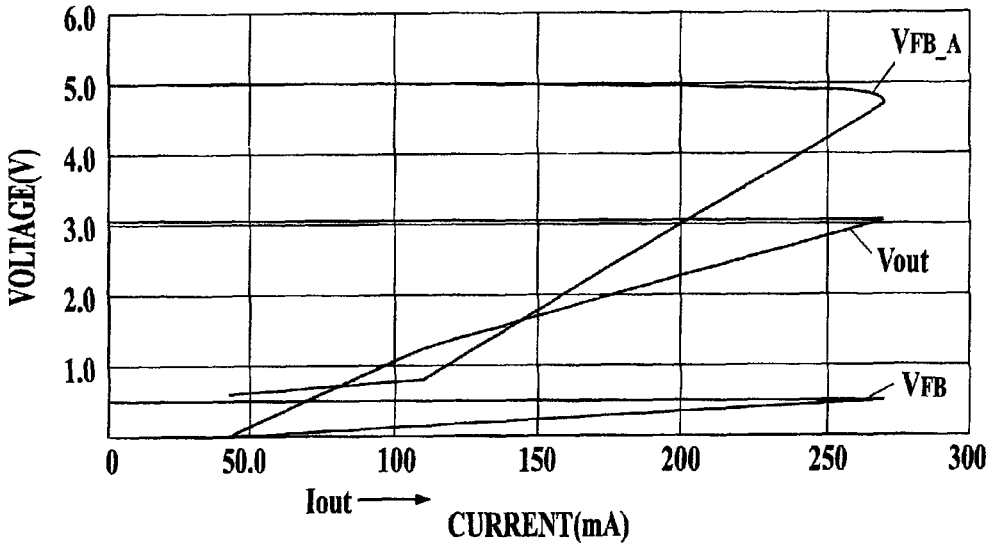
FIG. 3 is a voltage-current characteristics chart showing results of investigating, by a simulation, relationships among an output current, an output voltage and a feedback voltage in the control IC of the series regulator of the embodiment and a potential in an inside of a current limiter & soft start circuit.
Figure 4:
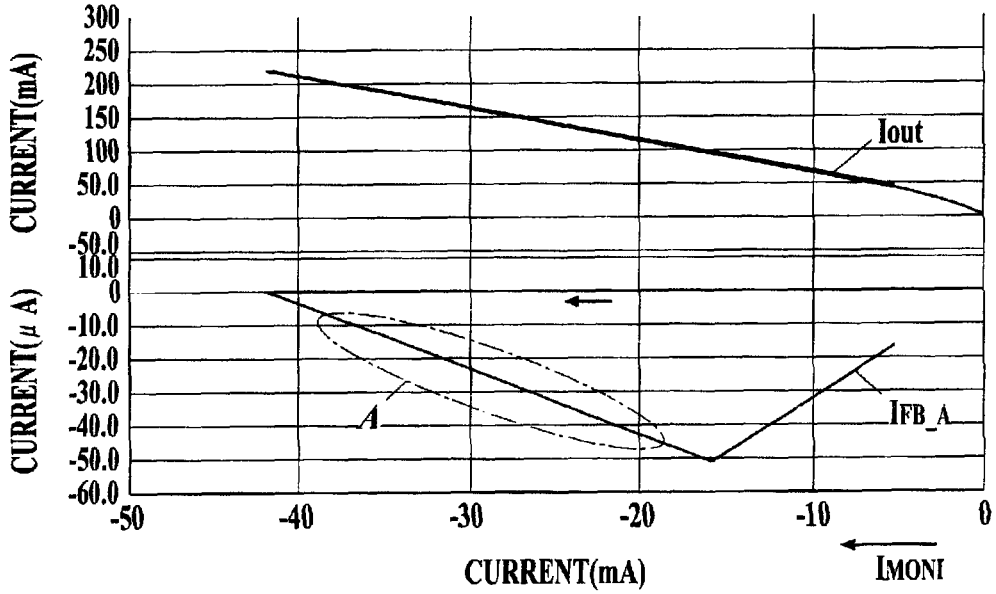
FIG. 4 is a graph showing results of investigating, by a simulation, relationships among a detecting current and the output current in the controlling IC of the series regulator of the embodiment and a current in the inside of the current limiter & soft start circuit.

FIG. 3 shows results of performing a simulation for the series regulator IC configured as described above and investigating states of changes of the output voltage Vout, the output voltage $V_{FB_A}$ of the differential amplifier 15 and the feedback voltage $V_{FB}$ the output current Iout is changed. Moreover, FIG. 4 shows results of performing a simulation and investigating a state of a change of the current $I_{FB_A}$ of the MOS transistor M2 with respect to the current $I_{MONI}$ flowing through the MOS transistor M1 when the output current Iout is changed under a condition where the current $I_{MONI}$ is taken on an axis of abscissas. Note that the input voltage $V_{DD}$ is set at 5.0V, and the power supply voltage of the differential amplifier is also set at 5.0V. In FIG. 3, when the output voltage $V_{FB_A}$ of the differential amplifier 15 is lowered, a gradient thereof is changed in the vicinity where Iout is equal to 110 mA. This is because the transistor M4 is turned off at a lower potential than that of the vicinity concerned.

An upper stage of FIG. 4 shows a relationship between the current $I_{MONI}$ and the output current Iout, and the relationship exhibits a linear shape, and accordingly, it is understood that the current $I_{MONI}$ is proportional to the output current Iout. In the $I_{MONI}$-$I_{FB_A}$ characteristics at the lower stage, when the current $I_{MONI}$ is increased in an arrow direction, then a limiter is applied in the vicinity of 42 μA, the current $I_{MONI}$ and the current $I_{FB_A}$ are decreased simultaneously to the vicinity of 16 μA, and when the current $I_{MONI}$ is decreased to 16 μA or less, the current $I_{FB_A}$ is increased. This is because an output dynamic range of the differential amplifier 15 is insufficient. However, since the output current is decreased sufficiently, current limit characteristics are not largely affected thereby, and such insufficiency is ignorable. In accordance with the $I_{MONI}$-$I_{FB_A}$ characteristics at the lower stage, a straight line in a region surrounded by an alternate long and short dashed line and denoted by reference symbol A is inclined in the same direction as the straight line of the $I_{MONI}$-Iout characteristics at the upper stage. Accordingly, it is understood that, in such a range where the current $I_{MONI}$ is 16 μA to 42 μA, the current $I_{FB_A}$ of the MOS transistor M2 is proportional to the current $I_{MONI}$, that is, the output current Iout.

Figure 5A:
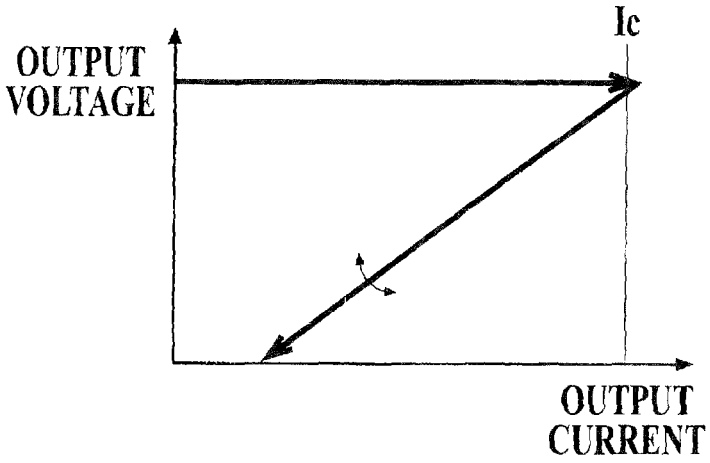
FIGS. 5A and 5B are graphs showing output voltage-output current characteristics and power consumption-output current characteristics in the control IC of the series regulator of the embodiment, respectively.

In accordance with the above-described simulation results, as shown in FIG. 5A, the series regulator IC of the embodiment in FIG. 1 controlled so that the output voltage Vout can be substantially constant regardless of the magnitude of the output current Iout in a range where the output current Iout is a predetermined value Ic or less. However, when such an accident as a short circuit occurs in a load (not shown) supplied with the output current Iout, the output current Iout is increased, and exceeds the predetermined current value Ic, then the voltage $V_{MONI}$ becomes larger than the voltage $V_{FB}$ ($V_{MONI}>V_{FB}$), the function of the current limiter works, and the output voltage Vout and the output current Iout start to be decreased simultaneously. Then, at this time, the output voltage Vout and the output current Iout are decreased while keeping the proportional relationship therebetween, and accordingly, are changed substantially linearly.

Figure 5B:
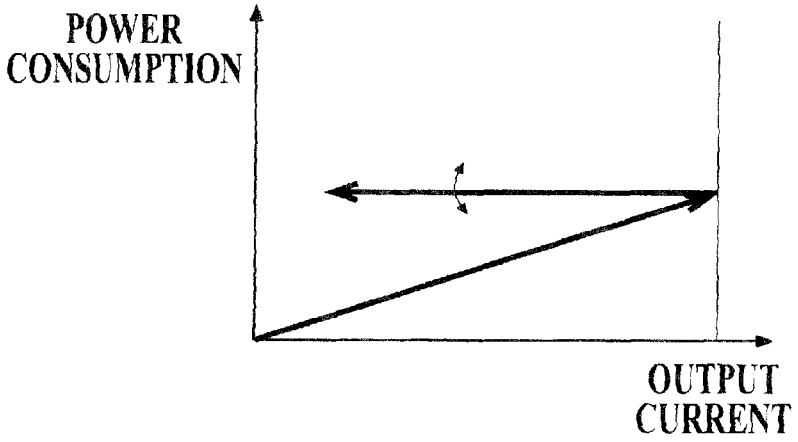
Figure 9A:
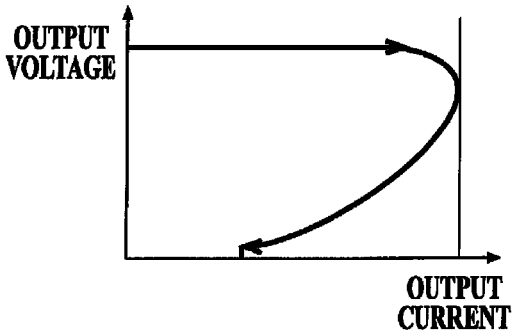
FIG.9A Prior Art
FIGS. 9A and 9B are graphs showing reverse-C type output voltage-output current characteristics and power consumption-output current characteristics in the conventional series regulator, respectively.
Figure 9B:
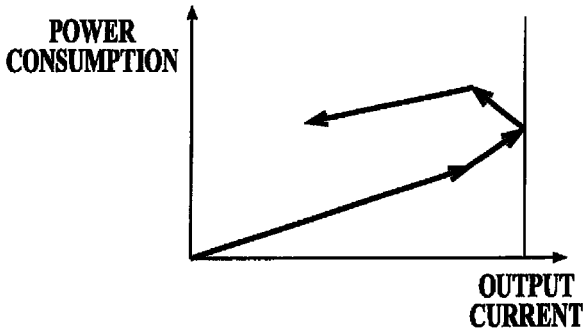
FIG.9B Prior Art

That is to say, in the conventional current limiter, as shown in FIG. 9A, there appear characteristics in which a diagonal direction portion of the reverse-C shape swells outward, and the power consumption is thereby increased as shown in FIG. 9B, and meanwhile, in this embodiment, the output voltage is changed in accordance with the linear reverse-C characteristics as shown in FIG. 5A. As a result, the power consumption-output current characteristics become as shown in FIG. 5B, and the increase of the power consumption in the event where the current limit is applied can be suppressed in comparison with the conventional current limiter. Note that, in FIG. 5B, there appear characteristics where a linear portion in a lateral direction of the reverse-C shape is horizontal; however, in this portion, an angle thereof is changed in response to a gradient of a linear portion in a diagonal direction of the reverse-C shape of the voltage-current characteristics in FIG. 5A. Hence, desirably, the gradient of the diagonal linear portion of the reverse C shape of the voltage-current characteristics of FIG. 5A is decided so that an upper linear portion of the reverse C shape of the voltage-current characteristics in FIG. 5B can be horizontal, and the size and the like of the transistors which compose the circuit are set so as to obtain such characteristics as described above. By making setting as described above, the increase of the power consumption can be prevented.

Figure 7:
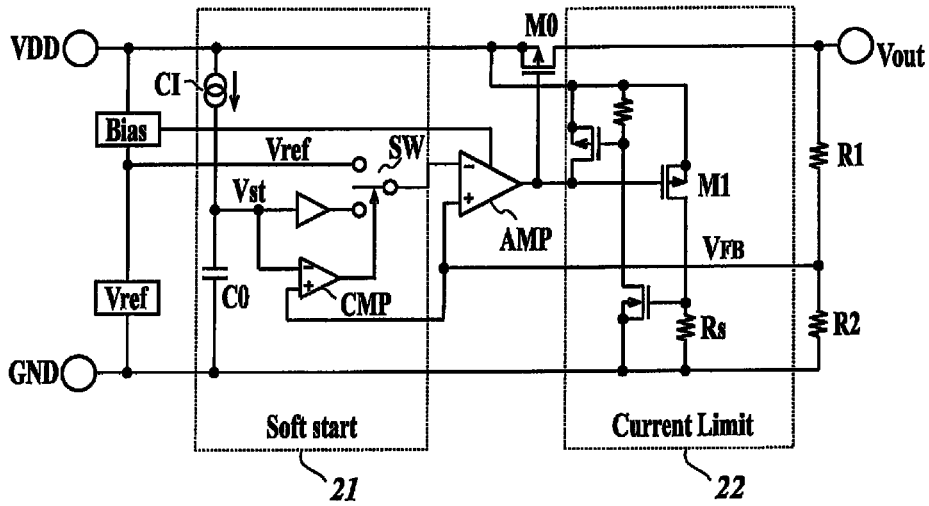
FIG. 7 Prior Art
FIG. 7 is a circuit configuration diagram showing an example of a conventional series regulator including a current limiter circuit and a soft start circuit.
Figure 8A:
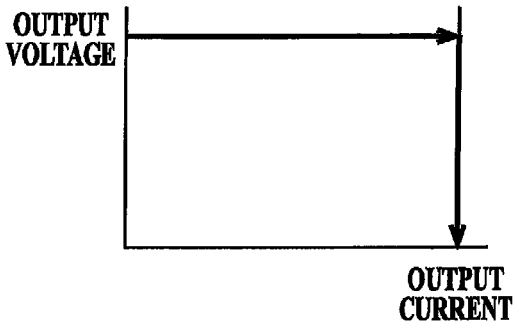
FIG.8A Prior Art
FIGS. 8A and 8B are graphs showing output voltage-output current characteristics of a drooping type and power consumption-output current characteristics in the conventional series regulator, respectively.
Figure 8B:
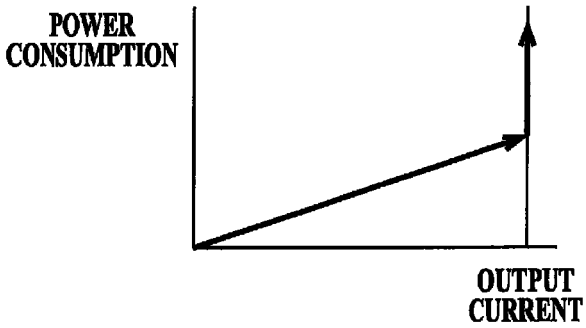
FIG.8B Prior Art

As mentioned above, in the series regulator IC in FIG. 1, one circuit can be imparted with the function of the current limiter circuit and the function of the soft start circuit. Accordingly, in comparison with the case where the two circuits are provided separately from each other as shown in FIG. 7, the constant current source CI, capacitor C0, voltage switching switch and the like of the soft start circuit become unnecessary. Moreover, in the case where the series regulator IC is formed into a semiconductor integrated circuit, in general, an external element is used as the capacitor C0, and accordingly, a dedicated capacitor connecting terminal becomes necessary. However, if the embodiment of the present invention is applied, such an external terminal also becomes necessary. As a result, in the case of forming the series regulator into the semiconductor integrated circuit, there is an advantage that a chip area can be reduced by approximately 15%.

Figure 6:
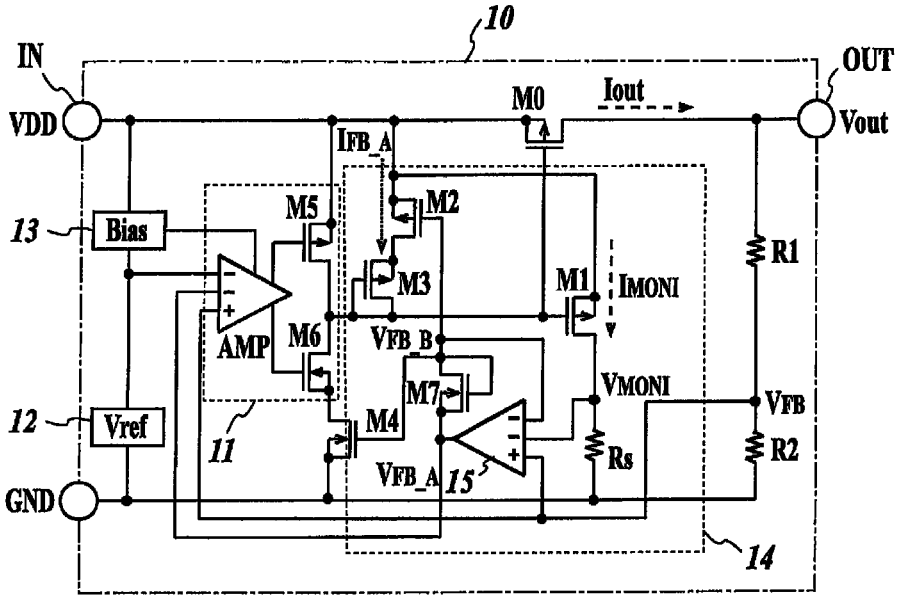
FIG. 6 is a circuit configuration diagram showing a modification example of the controlling IC of the series regulator of the embodiment.

FIG. 6 shows a modification example of the series regulator IC of the above-described embodiment.

In this modification example, an N-channel MOS transistor M7 of so-called diode connection, in which a gate and a drain are bonded to each other, is connected between the output terminal of the differential amplifier 15 and the gate terminal of the MOS transistor M2 for the current limit. Other configurations are similar to those of the circuit in FIG. 1. The transistor M7 has a level shift function, and by providing the transistor M7, a degree of freedom in setting the potentials of the voltages $V_{FB_A}$ and $V_{FB_B}$ rises, and there is an advantage that it is facilitated to optimize the element sizes of the transistors M2 and M4 and to adjust a start time by the soft start function. That is to say, if the optimization of the potentials of the voltages $V_{FB_A}$ and $V_{FB_B}$ is attempted to be performed only by the element sizes of the transistors M2 and M4 without providing the transistor M7, the size of one of the transistors sometimes becomes extremely large and meanwhile, by providing the transistor M7, the optimization of the potentials of the voltages $V_{FB_A}$ and $V_{FB_B}$ and the adjustment of the start time can be performed while avoiding the enlargement of the sizes of the transistors M2 and M4.

Based on the embodiment, the description has been specifically made above of the invention made by the inventor of the present invention; however, the present invention is not limited to the embodiment. For example, in the embodiment, the one using the three-input differential amplifier circuit is shown as each of the error amplifier 11 and the differential amplifier 15; however, for each thereof, two or more two-input differential amplifiers may be provided, and a circuit that works similarly may be configured.

Moreover, in each of the regulators in FIG. 1 and FIG. 6, the one is shown, in which the MOS transistors are used as the transistors which compose the circuit; however, the present invention can also be applied to a circuit using bipolar transistors in place of the MOS transistors. Furthermore, in the regulator IC of the embodiment, the reference voltage circuit that generates the reference voltage Vref serving as a reference of the error amplifier 11 is provided in the inside of the chip; however, a configuration may be adopted so that the reference voltage Vref can be given from the outside of the chip by providing an external terminal.

Moreover, the description has been made above of the example where the present invention is applied to the series regulator IC; however, the present invention is not limited to this, and can be used for a charge controlling IC that composes a charge device that charges a secondary battery.

According to an aspect of the preferred embodiment of the present invention, there is provided a semiconductor integrated circuit for a regulator, comprising:

a controlling transistor connected between an input terminal and an output terminal;

a current detection circuit that detects an output current flown from the controlling transistor and outputs a detection voltage proportional to the output current;

a feedback voltage generation circuit that generates a feedback voltage proportional to an output voltage in a reduction manner; and a control circuit that controls the controlling transistor that the output voltage is constant in response to the feedback voltage, wherein the control circuit includes:

a first circuit that receives the detection voltage and the feedback voltage, functions as a comparator during a period in which the output current is higher than a predetermined value, and functions as a buffer that outputs a voltage proportional to the feedback voltage during a period in which the output current is lower than the predetermined value;

a second circuit that receives a voltage serving as a reference, the feedback voltage, and the voltage outputted from the first circuit, generates a voltage corresponding to a potential difference between the feedback voltage and the output voltage, of, the first circuit during a period in which the voltage serving as the reference is lower than the voltage outputted from first circuit, and when the voltage serving as the reference becomes higher than the voltage outputted from the first circuit, generates a voltage corresponding to a potential difference between the feedback voltage and the voltage serving as the reference, and supplies the generated voltage to a control terminal of the controlling transistor; and a current restricting transistor provided between the input terminal and the control terminal of the controlling transistor and controlled by the voltage outputted from the first circuit.

With the above-described configuration, when the input voltage rises, the second circuit generates the voltage corresponding to the potential difference between the feedback voltage and the output voltage of the first circuit, and supplies the generated voltage to the control terminal of the controlling transistor. Accordingly, the control is applied so that the output voltage can rise gradually, and the soft start function to suppress the rush current works. Moreover, when the output current is increased to exceed the predetermined value while the constant voltage control is being performed after the input voltage rises, then the first circuit comes to function as the buffer, and the overcurrent protection function works, in which the current restricting transistor is turned on by the voltage outputted from the first circuit, and the control is applied so as to reduce the current flowing through the controlling transistor. Therefore, the soft start function and the overcurrent protection function can be realized by one circuit, and the chip size can be reduced in the case of forming the series regulator into the semiconductor integrated circuit. Moreover, the linear reverse-C shape characteristics are realized, and it becomes possible to reduce the power loss when the overcurrent protection function works.

Preferably, the first circuit includes a three-input differential amplifier circuit having two inverting input terminals and one non-inverting input terminal, and is configured so that the feedback voltage is inputted to the non-inverting input terminal, the detection voltage is inputted to one of the two inverting input terminals, and the output of its own is subjected to feedback to the other one of the inverting input terminals.

Preferably, the second circuit includes a three-input differential amplifier circuit having two inverting input terminals and one non-inverting input terminal, and is configured so that the feedback voltage is inputted to the non-inverting input terminal, and the voltage serving as the reference and the voltage outputted from the first circuit are inputted to the two inverting input terminals.

The three-input differential amplifier circuits are used for the first circuit and the second circuit, whereby the number of elements which compose the circuit is reduced in comparison with the case of using a plurality of amplifiers, and it becomes possible to reduce the chip size.

Preferably, a differential amplifier circuit of the second circuit includes an output stage having first and second transistors connected in series to each other, in which a third transistor is connected in series to the second transistor, and the voltage outputted from the first circuit is applied to a control terminal of the third transistor.

In such a way, both of the current restricting transistor and the third transistor are controlled by the voltage outputted from the first circuit, whereby it is facilitated to adjust the changes of the potentials in the inside of the circuit.

Preferably, between the input terminal and the control terminal of the controlling transistor, an element that functions as a diode is connected in series to the current restricting transistor.

In such a way, the influence of the output of the second circuit to the controlling transistor when the overcurrent protection function works is made small, it is facilitated to adjust the control voltage of the controlling transistor by the current restricting transistor, and the current restriction operation can be executed in accordance with desired reverse-C shape characteristics.

Preferably, between a control terminal of the current restricting transistor and an output terminal of the first circuit, an element that functions as a diode is connected.

In such a way, it becomes easy to design the circuit so as to be provided with the desired reverse-C shape characteristics, and it becomes possible to easily reduce the power loss when the overcurrent protection function works.

Preferably, the current detection circuit includes a current detecting transistor that composes a current mirror with the controlling transistor, and a current-voltage converter connected in series to the current detecting transistor, and wherein the voltage outputted from the second circuit is applied to a control terminal of the current detecting transistor, and a current proportional to the output current in a reduction manner flows through the current detecting transistor and the current-voltage converter.

The magnitude of the output current is detected by the current detecting transistor that composes the current mirror with the controlling transistor, and accordingly, accurate current detection can be performed. In addition, a current mirror ratio is taken largely, whereby the power loss that follows the current detection can be reduced.

In accordance with the present invention, the semiconductor integrated circuit for a regulator can be realized, which can realize the soft start function and the overcurrent protection function by one circuit, and can reduce the circuit scale and the chip size. Moreover, there is an effect that the semiconductor integrated circuit for a regulator can be realized, which prevents the power consumption from rising very much in the course after the overcurrent is detected by the overcurrent protection function.

The entire disclosure of Japanese Patent Application No. 2010-236106 filed on Oct. 21, 2010 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. A semiconductor integrated circuit for a regulator, comprising:

a controlling transistor connected between an input terminal and an output terminal;

a current detection circuit that detects an output current flown from the controlling transistor and outputs a detection voltage proportional to the output current;

a feedback voltage generation circuit that generates a feedback voltage proportional to an output voltage in a reduction manner; and a control circuit that controls the controlling transistor so that the output voltage is constant in response to the feedback voltage, wherein the control circuit includes:

a first circuit that receives the detection voltage and the feedback voltage, functions as a comparator during a period in which the output current is higher than a predetermined value, and functions as a buffer that outputs a voltage proportional to the feedback voltage during a period in which the output current is lower than the predetermined value;

a second circuit that receives a voltage serving as a reference, the feedback voltage, and the voltage outputted from the first circuit, generates a voltage corresponding to a potential difference between the feedback voltage and the output voltage of the first circuit during a period in which the voltage serving as the reference is lower than the voltage outputted from first circuit, and when the voltage serving as the reference becomes higher than the voltage outputted from the first circuit, generates a voltage corresponding to a potential difference between the feedback voltage and the voltage serving as the reference, and supplies the generated voltage to a control terminal of the controlling transistor; and a current restricting transistor provided between the input terminal and the control terminal of the controlling transistor and controlled by the voltage outputted from the first circuit.

2. The semiconductor integrated circuit for a regulator according to claim 1, wherein the first circuit includes a three-input differential amplifier circuit having two inverting input terminals and one non-inverting input terminal, and is configured so that the feedback voltage is inputted to the non-inverting input terminal, the detection voltage is inputted to one of the two inverting input terminals, and the output of its own is subjected to feedback to the other one of the inverting input terminals.

3. The semiconductor integrated circuit for a regulator according to claim 1, wherein the second circuit includes a three-input differential amplifier circuit having two inverting input terminals and one non-inverting input terminal, and is configured so that the feedback voltage is inputted to the non-inverting input terminal, and the voltage serving as the reference and the voltage outputted from the first circuit are inputted to the two inverting input terminals.

4. The semiconductor integrated circuit for a regulator according to claim 3, wherein a differential amplifier circuit of the second circuit includes an output stage having first and second transistors connected in series to each other, in which a third transistor is connected in series to the second transistor, and the voltage outputted from the first circuit is applied to a control terminal of the third transistor.

5. The semiconductor integrated circuit for a regulator according to claim 1, wherein, between the input terminal and the control terminal of the controlling transistor, an element that functions as a diode is connected in series to the current restricting transistor.

6. The semiconductor integrated circuit for a regulator according to claim 5, wherein, between a control terminal of the current restricting transistor and an output terminal of the first circuit, an element that functions as a diode is connected.

7. The semiconductor integrated circuit for a regulator according to claim 1, wherein the current detection circuit includes a current detecting transistor that composes a current mirror with the controlling transistor, and a current-voltage converter connected in series to the current detecting transistor, and wherein the voltage outputted from the second circuit is applied to a control terminal of the current detecting transistor, and a current proportional to the output current in a reduction manner flows through the current detecting transistor and the current-voltage converter.

* * * * *